US012569003B2

(12) United States Patent
Wu

(10) Patent No.: US 12,569,003 B2
(45) **Date of Patent: *Mar. 10, 2026**

(54) PRE-ROLL FILLING SYSTEM

(71) Applicant: Clear IP Corporation, Stafford, TX (US)

(72) Inventor: Jeff Wu, Stafford, TX (US)

(73) Assignee: Clear IP Corporation, Stafford, TX (US)

( * ) Notice: Subject to any disclaimer, the term of this patent is extended or adjusted under 35 U.S.C. 154(b) by 216 days.

This patent is subject to a terminal disclaimer.

(21) Appl. No.: 18/396,974

(22) Filed: Dec. 27, 2023

(65) Prior Publication Data

US 2024/0156148 A1 May 16, 2024

Related U.S. Application Data

(63) Continuation of application No. 18/106,814, filed on Feb. 7, 2023.

(60) Provisional application No. 63/425,364, filed on Nov. 15, 2022.

(51) Int. Cl.
*A24C 5/02* (2006.01)
*A24C 5/60* (2006.01)

(52) U.S. Cl.
CPC ..... *A24C 5/02* (2013.01); *A24C 5/608* (2013.01)

(58) Field of Classification Search
None
See application file for complete search history.

(56) References Cited

U.S. PATENT DOCUMENTS

| | | | |
|---|---|---|---|
| 2,190,107 | A | 2/1940 | Pohle |
| 3,732,872 | A | 5/1973 | Lakritz |
| 3,847,162 | A | 11/1974 | Seil |
| 4,729,206 | A | 3/1988 | Francis et al. |
| 5,012,823 | A | 5/1991 | Keritsis et al. |
| 6,474,368 | B2 | 11/2002 | Clusserath et al. |
| 7,367,170 | B2 | 5/2008 | Hafker et al. |
| 8,047,377 | B2 | 11/2011 | Makino |
| 8,720,449 | B2 | 5/2014 | Dipple |
| 9,295,284 | B2 | 3/2016 | Prestia et al. |
| 10,440,989 | B2 | 10/2019 | Gardella et al. |
| 10,583,949 | B1 | 3/2020 | Ellis |
| 10,648,995 | B2 | 5/2020 | Accurso et al. |
| 11,414,221 | B2 | 8/2022 | Holderman et al. |
| 11,903,409 | B2 | 2/2024 | Partansky et al. |

(Continued)

FOREIGN PATENT DOCUMENTS

| | | | |
|---|---|---|---|
| CN | 102511920 | A | 6/2012 |
| CN | 204448438 | U | 7/2015 |

(Continued)

OTHER PUBLICATIONS

Thompson Duke Industrial, "Big Jim," [Retrieved Oct. 1, 2025, from the Internet: https://thompsondukeindustrial.com/product/big-jim-infusion-machine], 16 pages.

(Continued)

*Primary Examiner* — Phu H Nguyen
(74) *Attorney, Agent, or Firm* — Polsinelli PC

(57) ABSTRACT

A pre-roll filling system is provided. A pre-roll receiving component is operable to receive a plurality of pre-rolls. The pre-rolls are arranged in at least one row extending along a longitudinal axis. A translating component is operable to translate the pre-roll receiving component along the longitudinal axis. A filling component including at least one needle component is operable to deposit infusion material via at least one needle into the pre-rolls as the pre-roll receiving component translates along the longitudinal axis.

18 Claims, 14 Drawing Sheets

(56) References Cited

U.S. PATENT DOCUMENTS

| | | | |
|---|---|---|---|
| 2002/0078970 | A1 | 6/2002 | Grzonka et al. |
| 2007/0102014 | A1 | 5/2007 | Hafker et al. |
| 2009/0165809 | A1 | 7/2009 | Karles et al. |
| 2012/0192881 | A1 | 8/2012 | Dahan |
| 2012/0241045 | A1 | 9/2012 | Aouad |
| 2014/0283854 | A1 | 9/2014 | Magne |
| 2017/0119043 | A1 | 5/2017 | Swanson et al. |
| 2017/0188623 | A1 | 7/2017 | Cranford |
| 2021/0022388 | A1 | 1/2021 | Sullivan |
| 2022/0033124 | A1 | 2/2022 | Partansky et al. |
| 2023/0200433 | A1 | 6/2023 | Partansky et al. |

FOREIGN PATENT DOCUMENTS

| | | | |
|---|---|---|---|
| CN | 205527667 | U | 8/2016 |
| CN | 205547325 | U | 9/2016 |
| CN | 106199031 | A | 12/2016 |
| DE | 10052409 | C1 | 11/2001 |
| DE | 102015014231 | A1 | 5/2017 |
| KR | 10-0581552 | A | 2/2009 |

OTHER PUBLICATIONS

Dig, "DigBoston," Facebook, Jul. 14, 2017, [Retrieved Oct. 1, 2025, from the Internet:https://www.youtube.com/watch?v=DMdIS3YSdwY], 2 pages.

Air Vapor, "Transpring Vape Pen Auto Filler," YouTube, [Retrieved Oct. 1, 2025, from the Internet: https://www.youtube.com/watch?v=DMdIS3YSdwY], 4 pages.

auto cartridge filler.com, "Auto Cartridge Filler," YouTube, [Retrieved Oct. 1, 2025, from the Internet:: https://www.youtube.com/watch?v=NNzPBJQpLGQ], 3 pages.

Ellis, Jim, "Marijuana Oil Cartridge Filling Machine," YouTube [Retrieved Oct. 1, 2025, from the Internet: https://www.youtube.com/watch?v=gbegkscwzmY], 3 pages.

PRE-ROLL FILLING SYSTEM

CROSS-REFERENCE TO RELATED APPLICATIONS

This application is a continuation application of U.S. application Ser. No. 18/106,814, filed Feb. 7, 2023, which claims priority to U.S. Provisional Patent Application No. 63/425,364, filed in the U.S. Patent and Trademark Office on Nov. 15, 2022, each of which is incorporated herein by reference in its entirety for all purposes.

FIELD

The present disclosure relates generally to a pre-roll filling system. In at least one example, the present disclosure relates to a pre-roll filling system that automatically meters and deposits infusion material into the pre-rolls in an assembly line mechanism.

BACKGROUND

Pre-rolls are *cannabis* joints and/or blunts that have been loaded and rolled by a machine. Pre-rolls are filled with a base known as "trim," which can be a blend of buds and bits of leaf straight from the *cannabis* plant. The trim can be rolled in a blunt, joint, cone, or any similar wrap based on the user's preference. One of the most common types of *cannabis* trim is a flower, which is what people generally associate marijuana with. Another form of pre-rolled *cannabis* is shake, which is composed of a collection of A-grade or B-grade (popcorn) buds. Pre-rolled blunts and/or joints can also be infused with concentrates and can be mixed with any type of strain to create the desired experience.

BRIEF DESCRIPTION OF THE DRAWINGS

Further features of the present disclosure will become apparent to those skilled in the art to which the present disclosure relates from reading the following specification with reference to the accompanying drawings, in which.

DETAILED DESCRIPTION

Figure 1:
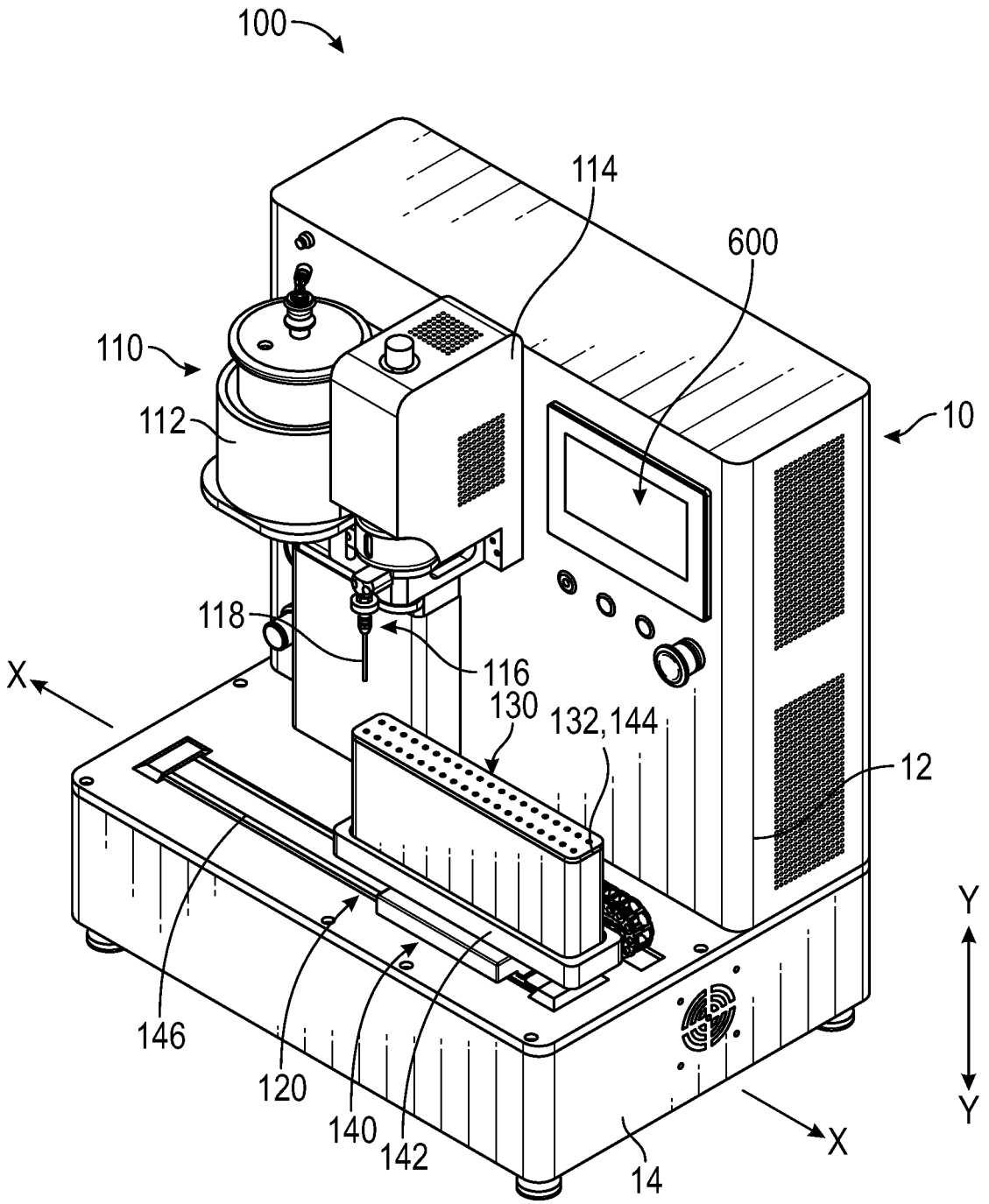
FIG. 1 is a perspective view of a pre-roll filling system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 illustrates a pre-roll filling system 100. The pre-roll filling system 100 can be operable to receive a plurality of pre-rolls and fill the pre-rolls with an infusion material in an assembly mechanism. In at least one example, the pre-roll filling system 100 can include a housing 10. The housing can include a vertical portion 12 and a table portion 14 that is substantially perpendicular to the vertical portion 12.

Figure 2A:
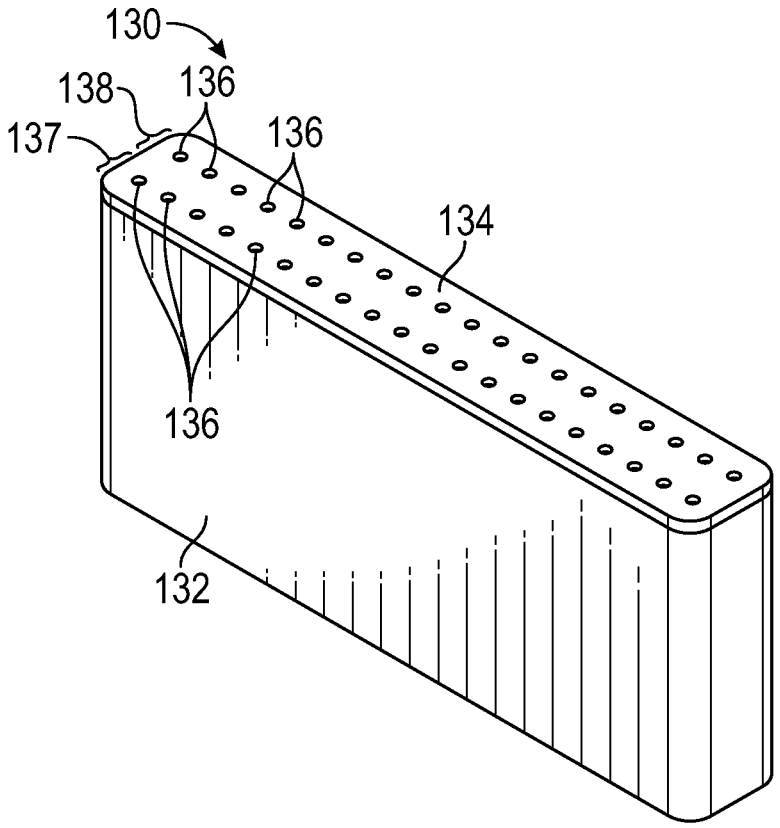
FIG. 2A is a perspective view of a pre-roll receiving component.
Figure 2B:
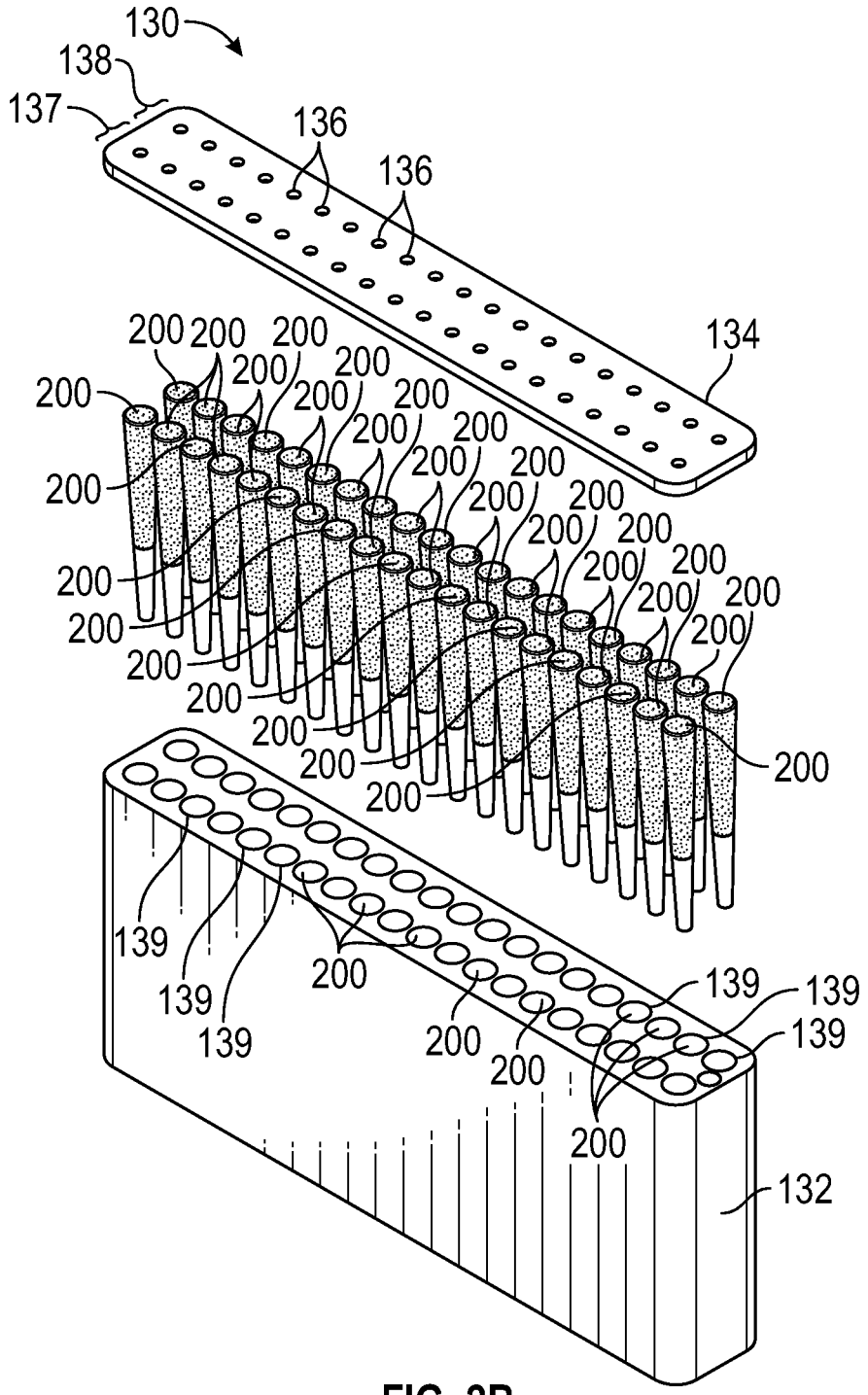
FIG. 2B is an exploded view of a pre-roll receiving component with pre-rolls.
Figure 2C:
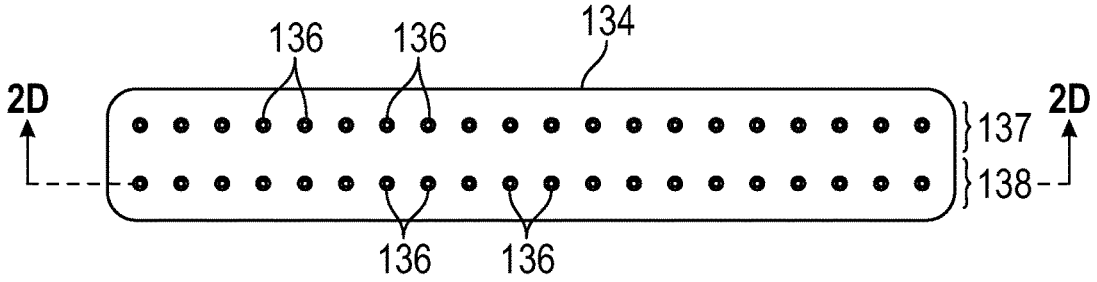
FIG. 2C is a top view of a pre-roll receiving component.
Figure 2D:
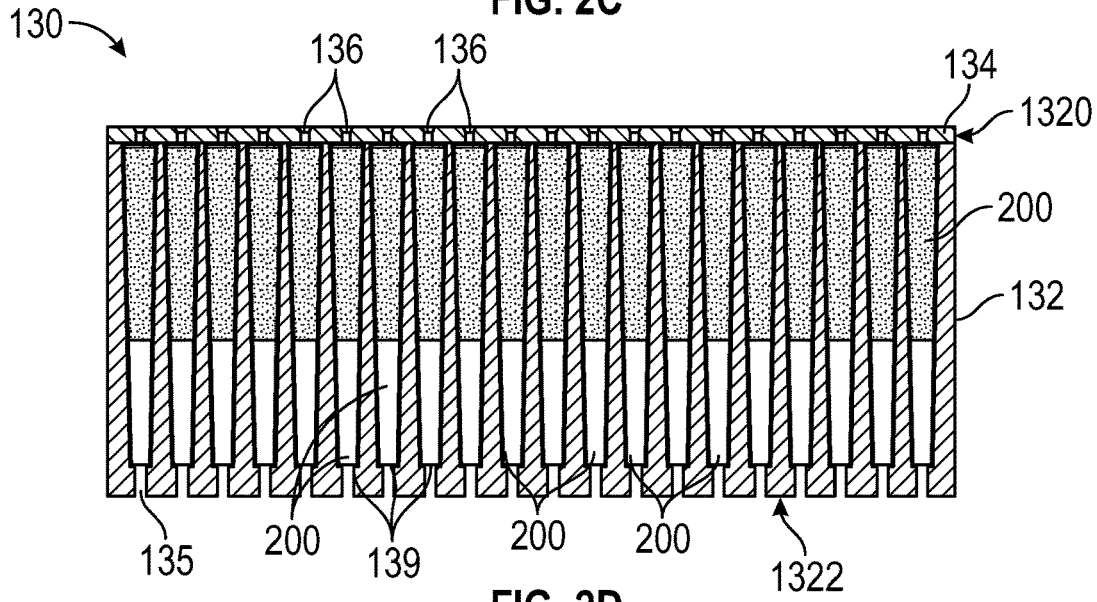
FIG. 2D is a cross-reference view of a pre-roll receiving component as taken along line 2D-2D of FIG. 2C, with pre-rolls loaded.
Figure 2E:
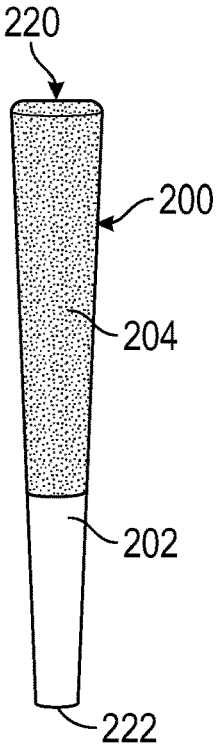
FIG. 2E is a cross-sectional view of a pre-roll.

The pre-roll filling system 100 can include a pre-roll receiving component 130 operable to receive a plurality of pre-rolls 200 (as shown in FIGS. 2B and 2D). In at least one example, pre-rolls 200 can include *cannabis* joints and/or blunts that can be filled with a filling material 204 (for example as shown in FIG. 2E) by the pre-roll filling system 100. In at least one example, the filling material 204 can include *cannabis*, trim, shake, and/or nugs. Other suitable filling materials 204 can be included without deviating from the scope of the disclosure.

Figure 3A:
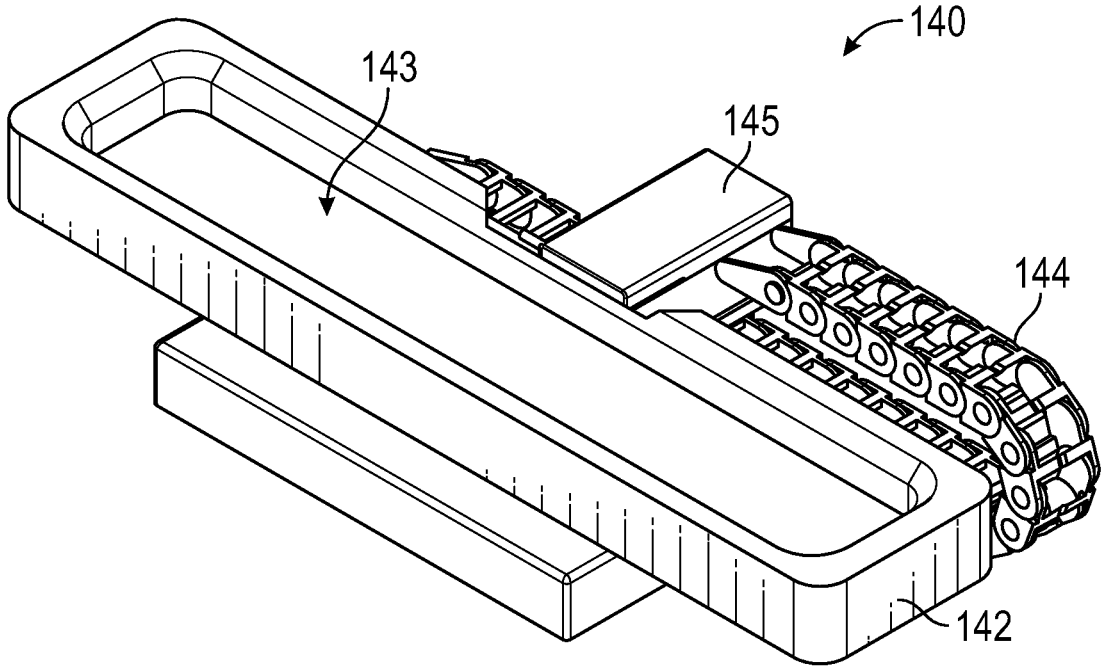
FIG. 3A is a perspective view of a translating component.
Figure 3B:
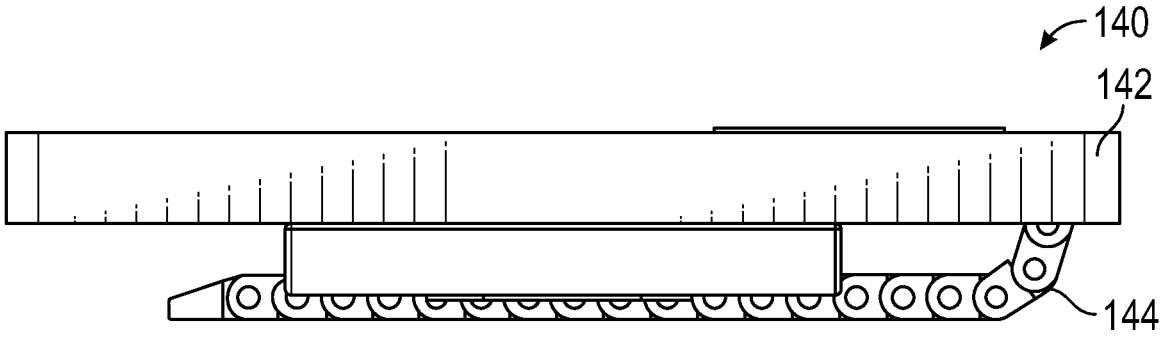
FIG. 3B is a side view of a translating component.
Figure 3C:
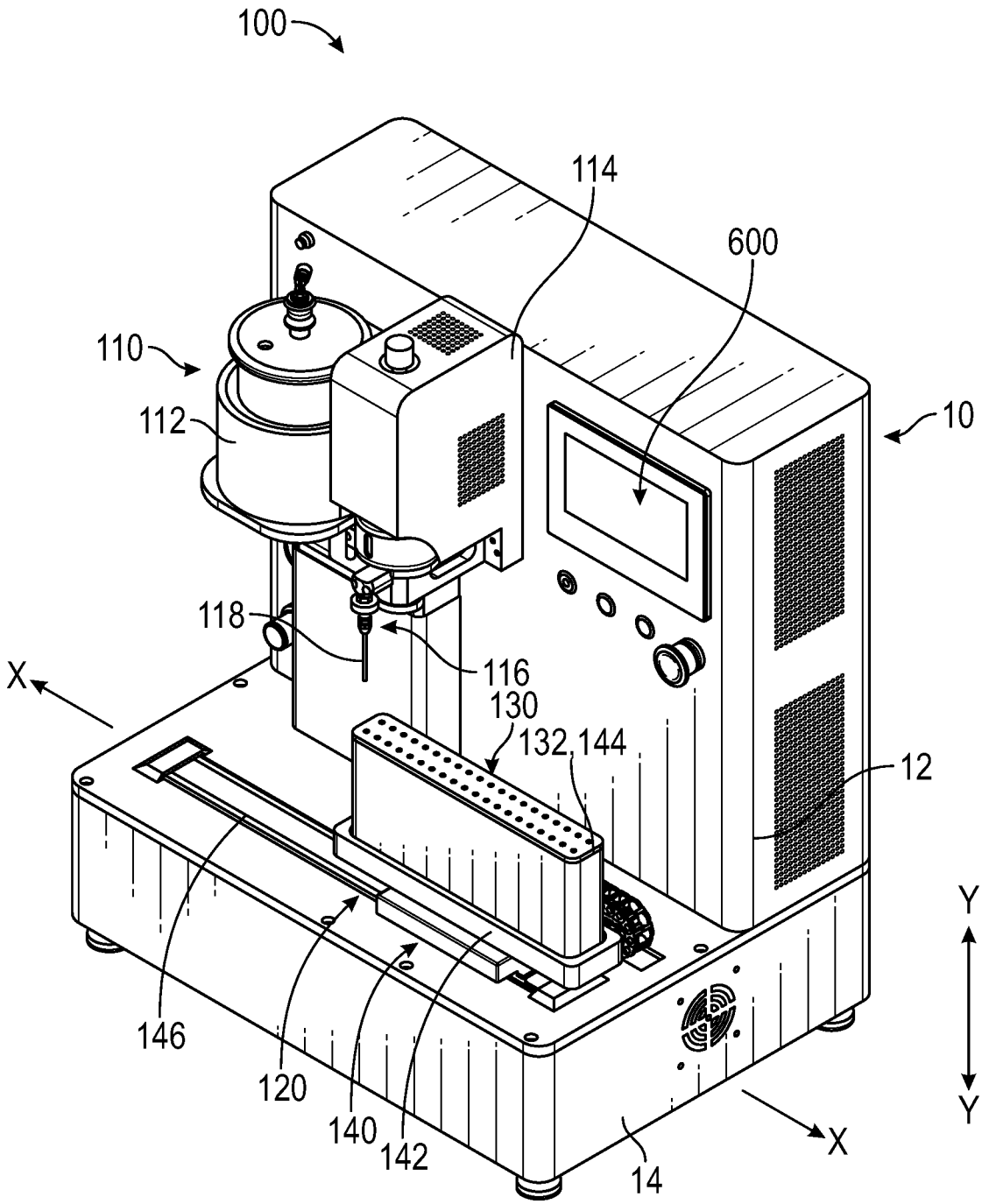
FIGS. 3C, 3D, and 3E are perspective views of a pre-roll filling system with the pre-roll receiving component translating and a filling component filling the pre-rolls.
Figure 3D:
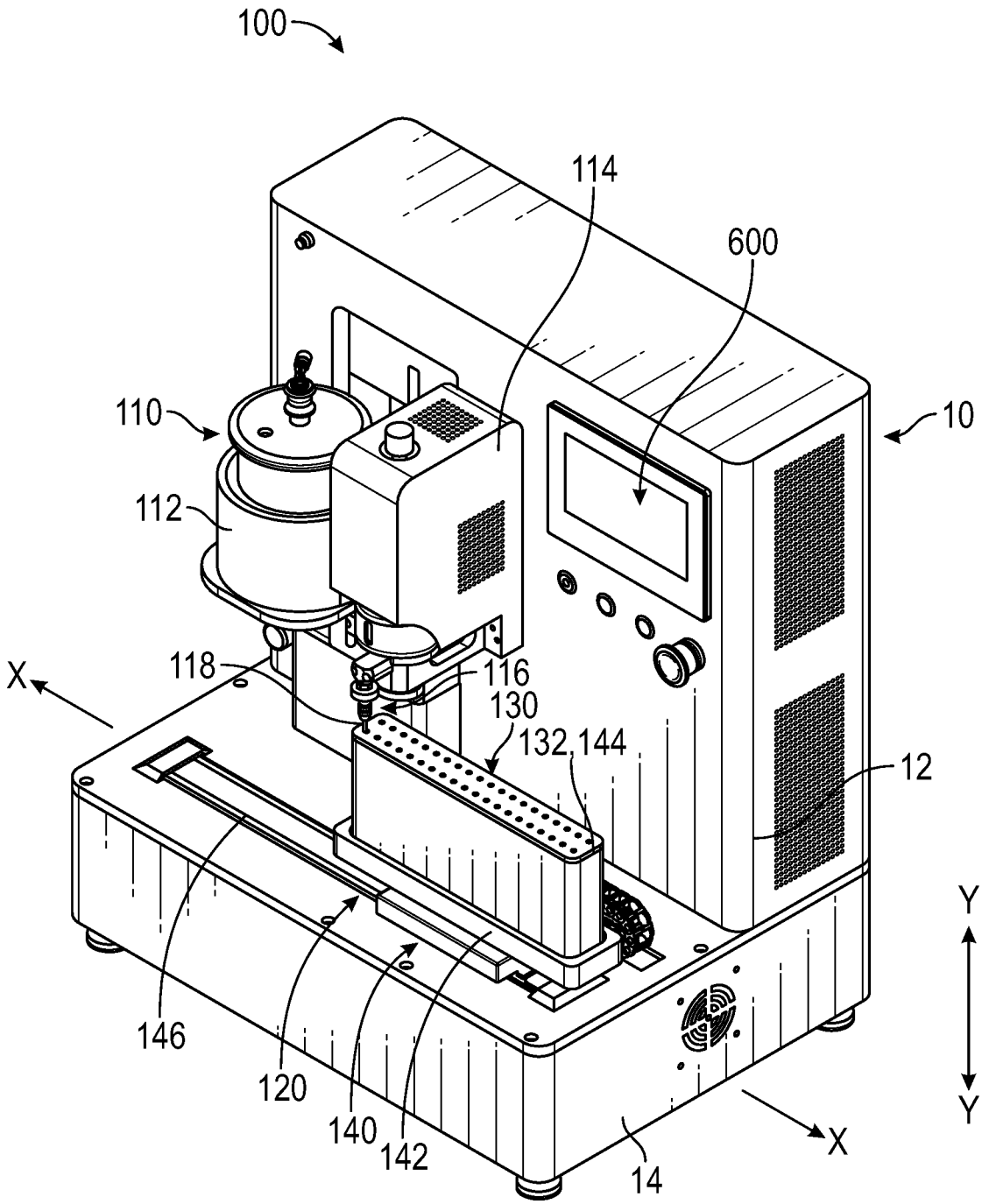
Figure 3E:
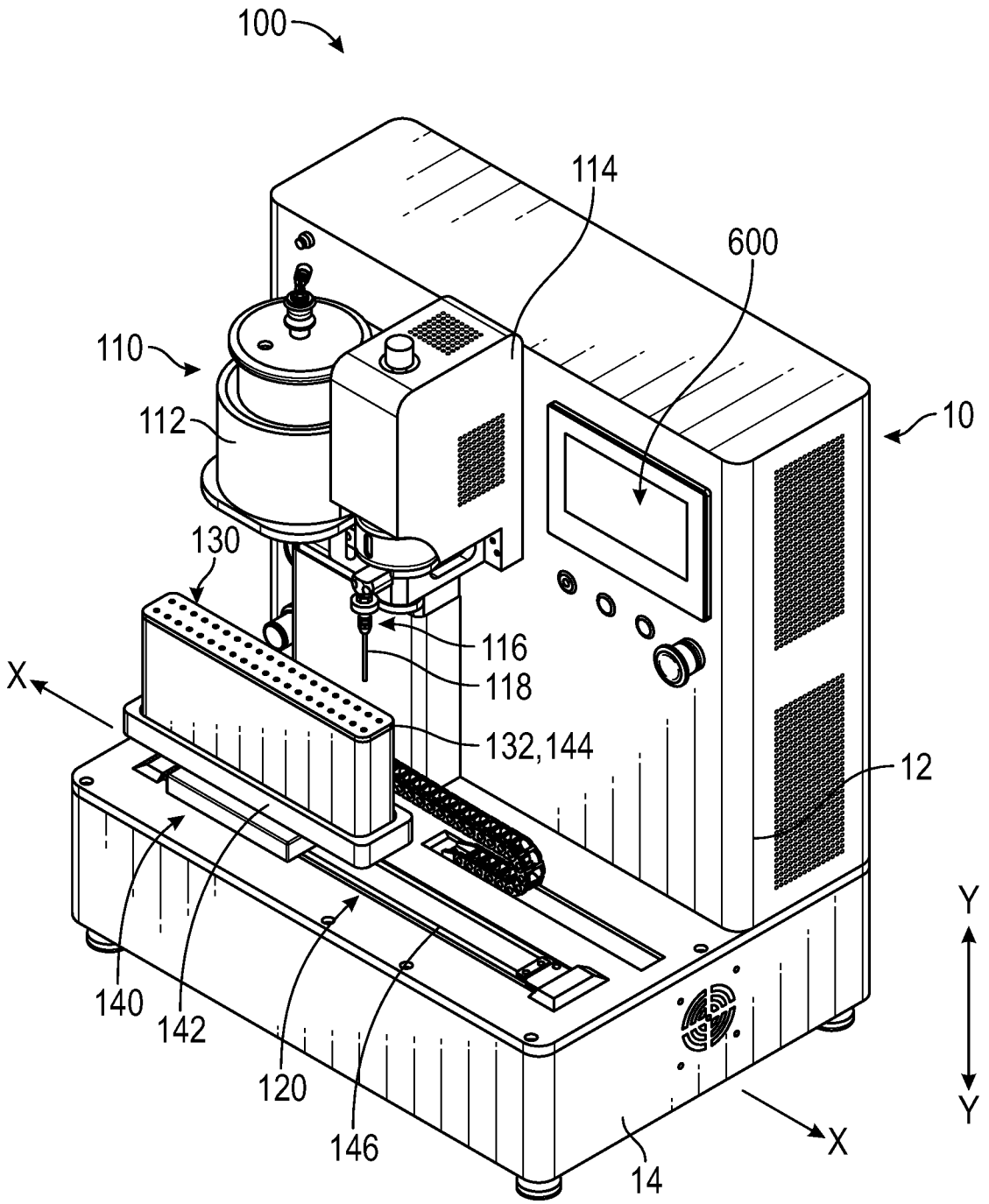
Figure 3H:
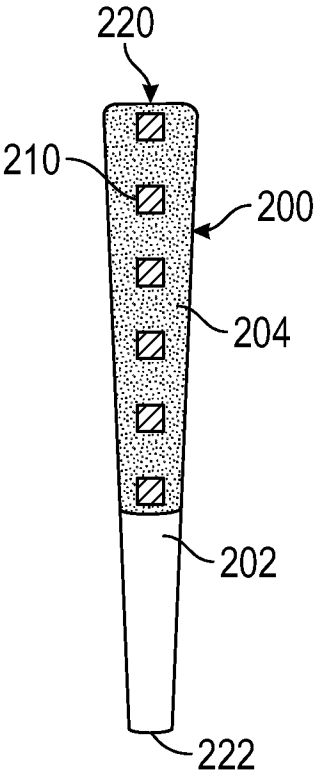
FIG. 3H is a cross-sectional view of a pre-roll filled with infusion material in a drop configuration.
Figure 3G:
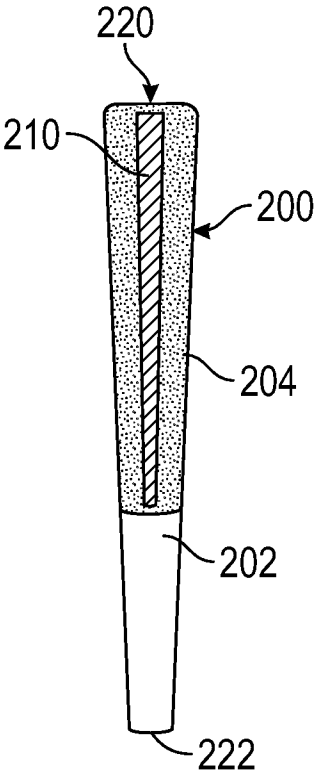
FIG. 3G is a cross-sectional view of a pre-roll filled with infusion material in a conical configuration.
Figure 3F:
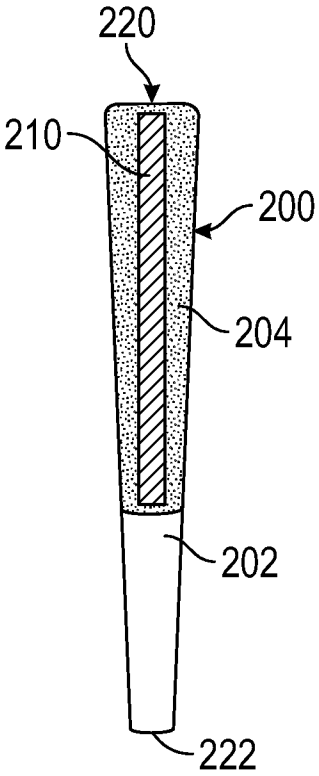
FIG. 3F is a cross-sectional view of a pre-roll filled with infusion material in a matchstick configuration.

The pre-roll filling system 100 is operable to meter and/or dispense infusion material 210 (for example as shown in FIGS. 3F and 3G) into the pre-rolls 200. In some examples, the infusion material 210 can include at least one of: terpene fluid, resin, rosin, sauce, distillate oil, hash, wax, flavoring material, etc. Other infusion material 210 can be included without deviating from the scope of the disclosure. The infusion material can be stored and/or dispensed by a filling component 110. The filling component 110 can include a material container 112 operable to receive and store the infusion material. The material container 112 can provide the infusion material to be dispensed via at least one needle component 116. The at least one needle component 116 can be operable to deposit infusion material 210 via at least one needle 118 into the plurality of pre-rolls 200 that are received in the pre-roll receiving component 130. In at least one example, a motor 114 can be operable to move the infusion material 210 from the material container 112 into the at least one needle component 116. In at least one example, the motor 114 can be operable to move the at least one needle component 116 and the at least one needle 118 along a vertical axis Y-Y to control the filling of the pre-rolls 200 in the pre-roll receiving component 130. A translating component 140 can be operable to translate the pre-roll receiving component 130 along a longitudinal axis X-X that is substantially transverse to the vertical axis Y-Y.

A controller 600 can be operable to control the operation of the pre-roll filling system 100. In at least one example, the controller 600 can control the motor 114 to move the infusion material 210 and/or the needle component 116. In at least one example, the controller 600 can move the translating component 140 to translate the pre-roll receiving component 130 along the longitudinal axis X-X. The controller 600 can coordinate the movement of the filling component 110 and the translating component 120 such that the pre-rolls 200 are filled with the desired configuration and/or the desired amount. In at least one example, the controller 600 can control the needle heater 402 (described in more detail below for FIGS. 5A and 5B) to control the heat (e.g., temperature) of needle 118 so that the infusion material 210 can pass through the needle 118 without clogging, sticking, etc. In at least one example, sensors such as temperature sensors, volume sensors, placement sensors can be utilized to provide data to the controller 600 to assist in ensuring that the pre-roll filling system 100 is adequately filling the pre-rolls 200 as desired. In at least one example, the controller 600 can make adjustments to the filling process (e.g., the filling component 110, the translating component 120, and/or the pre-roll receiving component 130) automatically without user assistance to ensure that the pre-roll filling system 100 is adequately filling the pre-rolls 200 as desired.

In at least one example, the filling component 110 (e.g., the material container 112, the motor 114, and/or the needle component 118) and/or the controller 600 can be coupled with the vertical portion 12. In some examples, the material container 112, the motor 114, the needle component 118, and/or the controller 600 can be disposed on the table portion 14.

As illustrated in FIGS. 2A-2D, the pre-roll receiving component 130 can include a filling container 132 operable to receive a plurality of pre-rolls 200. As shown in FIGS. 2B and 2D, the filling container 132 can include a plurality of holding channels 139 operable to receive the plurality of pre-rolls 200. The holding channels 139 can be arranged in at least one row 137, 138 extending along the longitudinal axis X-X. Correspondingly, the plurality of pre-rolls 200 are arranged in at least one row 137, 138 extending along the longitudinal axis X-X. As illustrated in FIGS. 2A-2D, the holding channels 139 and the pre-rolls 200 are arranged in two rows extending along the longitudinal axis X-X. In at least one example, as illustrated in FIG. 2D, the holding channels 139 can be tapered to correspond with the shape of the pre-rolls 200.

FIG. 2E illustrates an example of a pre-roll 200. The pre-roll 200 can have an outer wrap 202 that forms a tubular structure. When the outer wrap 202 is rolled into the tubular structure, the pre-roll 200 can receive the filling material 204 within the center annulus of the pre-roll 200. The pre-roll 200 can have a top end 220 and a bottom end 222 opposite the top end 220. The bottom end 222 may be inserted into a user's mouth. In some examples, the user may inhale through the bottom end 222 of the pre-roll 200. In some examples, when the pre-roll 200 is received in the holding channel 139 and the pre-roll filling system 100 is filling the pre-roll 200 with the infusion material 210, the top end 220 may be in an open configuration. In some examples, the top end 220 may be in a closed configuration. In at least one example, as illustrated in FIG. 2E, the pre-roll 200 can have a substantially conical or frustoconical shape. In some examples, the pre-roll 200 can have a substantially cylindrical shape. In some examples, the pre-roll 200 can have a substantially rectangular shape. The shape of the pre-roll 200 can vary without deviating from the scope of the disclosure.

In at least one example, as illustrated in FIGS. 2A-2D, the pre-roll receiving component 130 can include a cover 134 operable to couple with the filling container 132 and be positioned on top of the holding channels 139. The cover 134 can form a plurality of apertures 136 operable to receive the at least one needle 118. The plurality of apertures 136 correspond with and/or align with the plurality of pre-rolls 200 such that the needle 118 passes into and through the aperture 136 to be received by the pre-roll 200. Accordingly, the pre-roll 200 can be filled with the infusion material 210 while ensuring that the needle 118 is correctly positioned. Also, the cover 134 can prevent any spilling of the infusion material 210. In at least one example, the cover 134 can be removably coupled with the filling container 132.

In at least one example, the filling container 132 can be removable and replaceable within the pre-roll filling system 100. Accordingly, as the pre-rolls 200 in the pre-roll receiving component 130 are all filled, the filling container 132 can be removed and replaced with empty pre-rolls 200. In at least one example, a separate filling container 132 can replace the filled filling container 132. In some examples, the same filling container 132 can be replaced after removing the filled pre-rolls 200 and placing empty pre-rolls 200 into the holding channels 139.

Figure 2F:
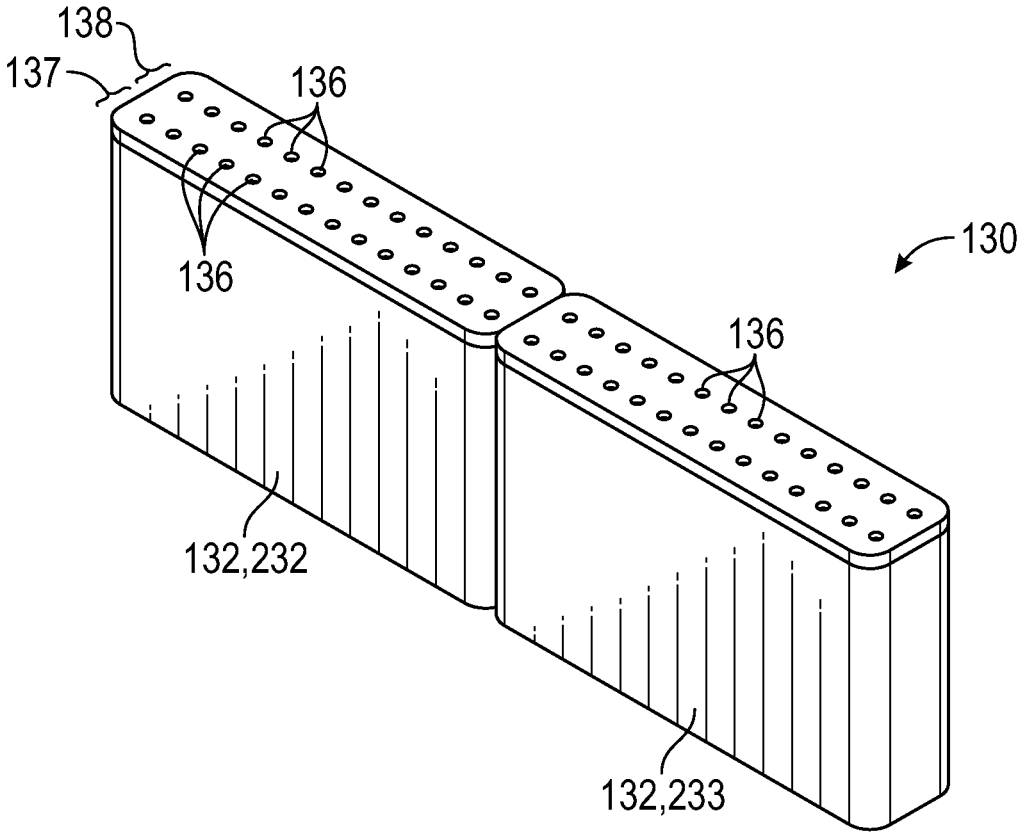
FIG. 2F is a perspective view of a pre-roll receiving component with two filling containers.

In at least one example, as illustrated in FIG. 2F, the pre-roll receiving component 130 can include at least two filling containers 132. Accordingly, after the pre-rolls 200 in a first filling container 232 are filled, the first filling container 232 can be removed and replaced with an empty filling container 132 while the second filling container 233 is being filled. Accordingly, the pre-rolls 200 can be filled in an assembly line mechanism without pausing the pre-roll filling system 100 while filling containers 132 are being replaced.

FIGS. 3A-3B illustrate the translating component 140. The translating component 140 can include a tray 142 operable to receive the pre-roll receiving component 130. The tray 142 can form a recess 143 having a shape that corresponds with the shape of the pre-roll receiving component 130. Accordingly, the pre-roll receiving component 130 can be securely received by the tray 142. The pre-roll receiving component 130 can be removably received by the tray 142.

In at least one example, the translating component 140 can include continuous tracks 144 that are moved by a motor 145. Accordingly, the translating component 140 is operable to translate the pre-roll receiving component 130 along the longitudinal axis X-X. In at least one example, the translating component 140 can be operable to translate the pre-roll receiving component 130 along the longitudinal axis X-X in a first direction. In at least one example, the translating component 140 can be operable to translate the pre-roll receiving component 130 along the longitudinal axis X-X in a first direction and a second direction opposite the first direction. Accordingly, the pre-roll receiving component 130 can be moved along the longitudinal axis X-X as needed to efficiently and effectively fill the pre-rolls 200 with the infusion material 210. In at least one example, the translating component 140 can be operable to translate the pre-roll receiving component 130 along a row axis transverse to the longitudinal axis X-X. The translating component 140 can move the pre-roll receiving component 130 so that the needle 118 can be aligned with a different row of the pre-roll receiving component 130. Accordingly, the needle 118 may not need to be moved to align with a different row. In some examples, the needle 118 can be moved and/or translated along the row axis to be aligned with a different row.

As illustrated in FIGS. 3C-3E, the controller 600 can coordinate the movement of the pre-roll receiving component 130 via the translating component 140 with the movement of the filling component 110 to efficiently and effectively fill the pre-rolls 200. As shown in FIGS. 3C and 3D, the translating component 140 has positioned the pre-roll receiving component 130 such that one of the apertures 136 or one of the holding channels 139 with a pre-roll 200 is aligned with the needle 118 of the filling component 110. The filling component 110 moves the needle component 116 into the pre-roll 200 to a predetermined depth in the pre-roll 200 (e.g., proximate a bottom of the pre-roll 200) and deposits the infusion material 210 into the pre-roll 200 as the needle 118 is lifted vertically towards a top of the pre-roll 200 (e.g., near the cover 132). As illustrated in FIG. 3E, the translating component 140 translates the pre-roll receiving component 130 along the longitudinal axis X-X so that each pre-roll 200 down the row 137, 138 in the filling container 132 is filled.

FIGS. 3F-3H illustrate examples of different configurations of the infusion material 210 deposited within the pre-roll 200.

As illustrated in FIG. 3F, the infusion material 210 can be deposited in a matchstick configuration. In a matchstick configuration, the width and/or diameter of the infusion material 210 deposited in the pre-roll 200 can be substantially uniform. Accordingly, the rate of vertical lift of the needle 118 and/or the dispense rate of the infusion material 210 out of the needle 118 can be substantially constant. In some examples, in the matchstick configuration, the infusion material 210 can be a substantially continuous column of material in the pre-roll 200. For example, the infusion material 210 can be continuously dispensed by the needle 118.

As illustrated in FIG. 3G, the infusion material 210 can be deposited in a conical configuration. In a conical configuration, the width and/or diameter of the infusion material 210 deposited in the pre-roll 200 increases as the infusion material 210 approaches the top end 220 of the pre-roll 200. In at least one example, to form the conical configuration of the infusion material 210, the dispense rate of the infusion material 210 from the needle 118 can increase as the needle 118 is lifted vertically and/or the rate that the needle 118 is lifted vertically can decrease as the needle 118 moves upward. In some examples, the conical configuration of the infusion material 210 can correspond with the conical shape of the pre-roll 200. With a conical configuration, the infusion material 210 and the filling material 204 can burn more evenly. As the volume of filling material 204 increases with the increasing diameter of the pre-roll 200, having a correspondingly increasing volume of infusion material 210 provides an even and consistent burn. In some examples, in the conical configuration, the infusion material 210 can be a substantially continuous column of material in the pre-roll 200. For example, the infusion material 210 can be continuously dispensed by the needle 118.

As illustrated in FIG. 3H, the infusion material 210 can be deposited in a drop configuration. In a drop configuration, the infusion material 210 may not be continuously deposited so that the infusion material 210 is not a continuous column of material in the pre-roll 200. For example, there may be gaps between infusion material 210, as the infusion material 210 is not continuously dispensed by the needle 118. In at least one example, the drop configuration can be combined with the matchstick configuration (as shown in FIG. 3H) or the conical configuration. For example, the width and/or diameter of the infusion material 210 deposited in the pre-roll 200 can be constant or increase.

Figure 4A:
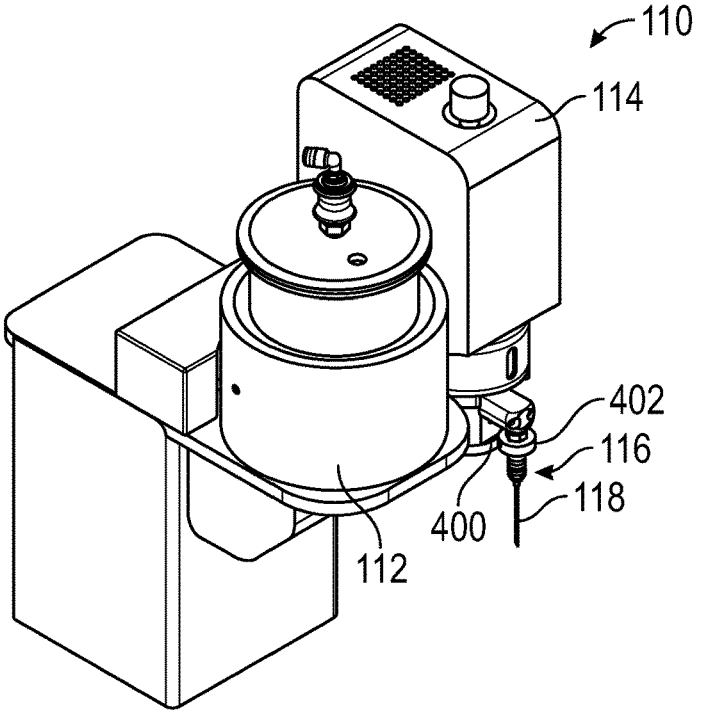
FIG. 4A is a perspective view of a filling component.

FIG. 4A illustrates the filling component 110. The filling component 110 can include a material container 112 operable to receive and store the infusion material 210. The material container 112 can provide the infusion material 210 to be dispensed via at least one needle component 116. The at least one needle component 116 can be operable to deposit infusion material 210 via at least one needle 118 into the plurality of pre-rolls 200 that are received in the pre-roll receiving component 130. In at least one example, a motor 114 can be operable to move the infusion material 210 from the material container 112 into the at least one needle component 116. In at least one example, the motor 114 can be operable to move the at least one needle component 116 and/or the at least one needle 118 along a vertical axis Y-Y to control the filling of the pre-rolls 200 in the pre-roll receiving component 130. In at least one example, the motor 114 can be operable to move the at least one needle component 116 and/or the at least one needle 118 along the row axis to align the needle 118 with a different row of the pre-roll receiving component 130.

Figure 4B:
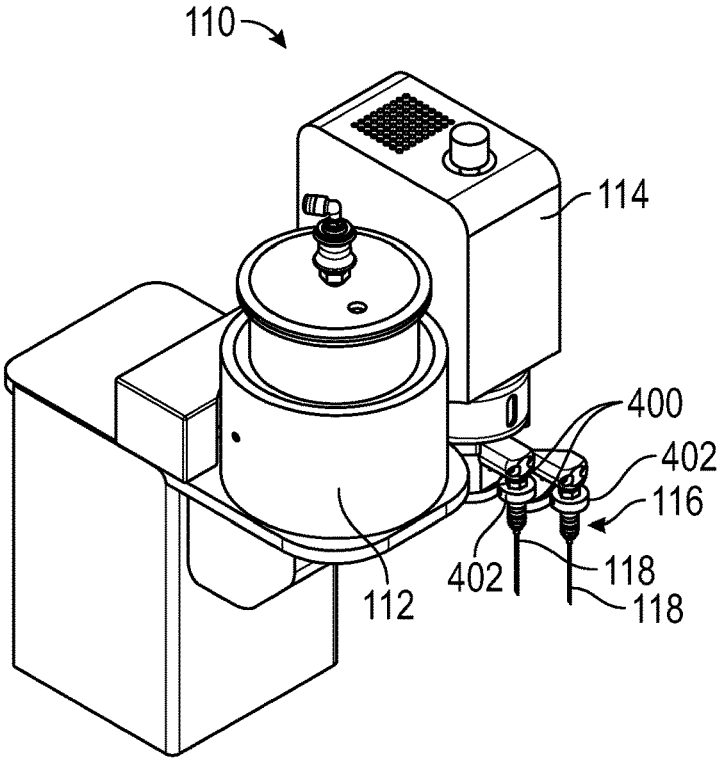
FIG. 4B is a perspective view of a filling component with two needles.

In some examples, as illustrated in FIG. 4B, the needle component 116 can include at least two needles 118. In some examples, at least two needle components 116 can be included, each including a needle 118. While FIG. 4B illustrates two needles 118, the number of needles 118 and/or needle components 116 can correspond with the number of rows 137, 138 of pre-rolls 200 to be filled in the pre-roll receiving component 130. The two needles 118 and/or needle components 116 can be arranged such that each of the two needles 118 corresponds with a corresponding row of the two rows 137, 138 of pre-rolls 200. Accordingly, the filling component 110 does not need to move the needle 118 to correspond with each row 137, 138 of pre-rolls 200 and/or the translating component 140 does not need to move the pre-roll receiving component 130 in another axis. The filling of the pre-rolls 200 in the pre-roll receiving component 130 becomes more efficient.

Figure 5B:
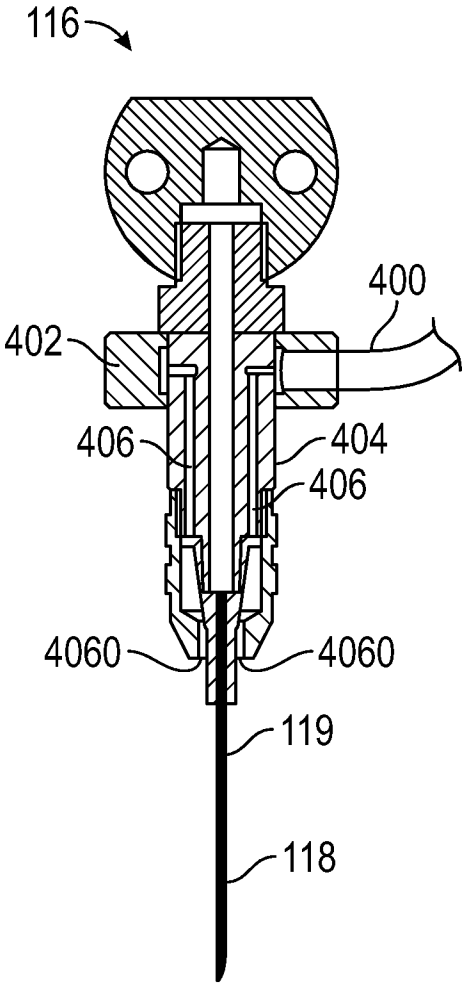
FIG. 5B is a cross-sectional view of a needle component taken along line N-N of FIG. 5A.
Figure 5A:
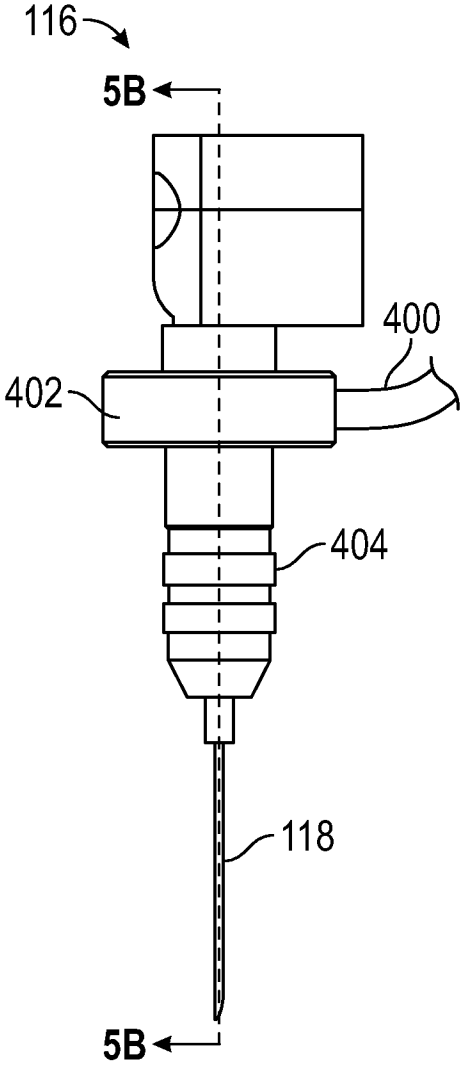
FIG. 5A is a side view of a needle component.

FIGS. 5A and 5B illustrate the needle component 116. The needle component 116 includes a needle receiver 404 operable to receive the needle 118. The needle receiver 404 can include at least one channel 406 that is in fluid communication with one or more ports 4060. The ports 4060 can be configured proximate a bottom of the needle receiver 404 (e.g., proximate the needle 118). In at least one example, as illustrated in FIGS. 5A and 5B, the needle component 116 can include a needle heater 402 that is coupled with the needle receiver 404. The needle heater 402 can be operable to receive and heat air flowing from an air source 400 (e.g., via a tube or a conduit). In at least one example, the air source 400 can include a compressor and/or a fan. The needle heater 402 can be in fluid communication with the needle receiver 404 such that the heated air from the needle heater 402 flows through the channels 406 and out of the one or more ports 4060. When the heated air flows out of the ports 4060, the heated air blows onto the needle 118 along the longitudinal axis of the needle 118. In at least one example, the heated air is blown down around and/or onto the needle 118 and forms a curtain of heated air around the needle 118. Accordingly, the needle 118 is effectively heated without additional external components that can malfunction, for example a conventional fan seizing up from oil getting caught in the blades or the rotor. In at least one example, the compressor can already be utilized for the pre-roll filling system 100, so additional components are not needed. Also, space within the pre-roll filling system 100 can be more efficiently utilized. Additionally, the infusion material 210 (e.g., oil) in the needle 118 is more effectively heated as the heated air directly heats the needle 118. The infusion material 210 can then flow out of the needle 118 more effectively.

Figure 6:
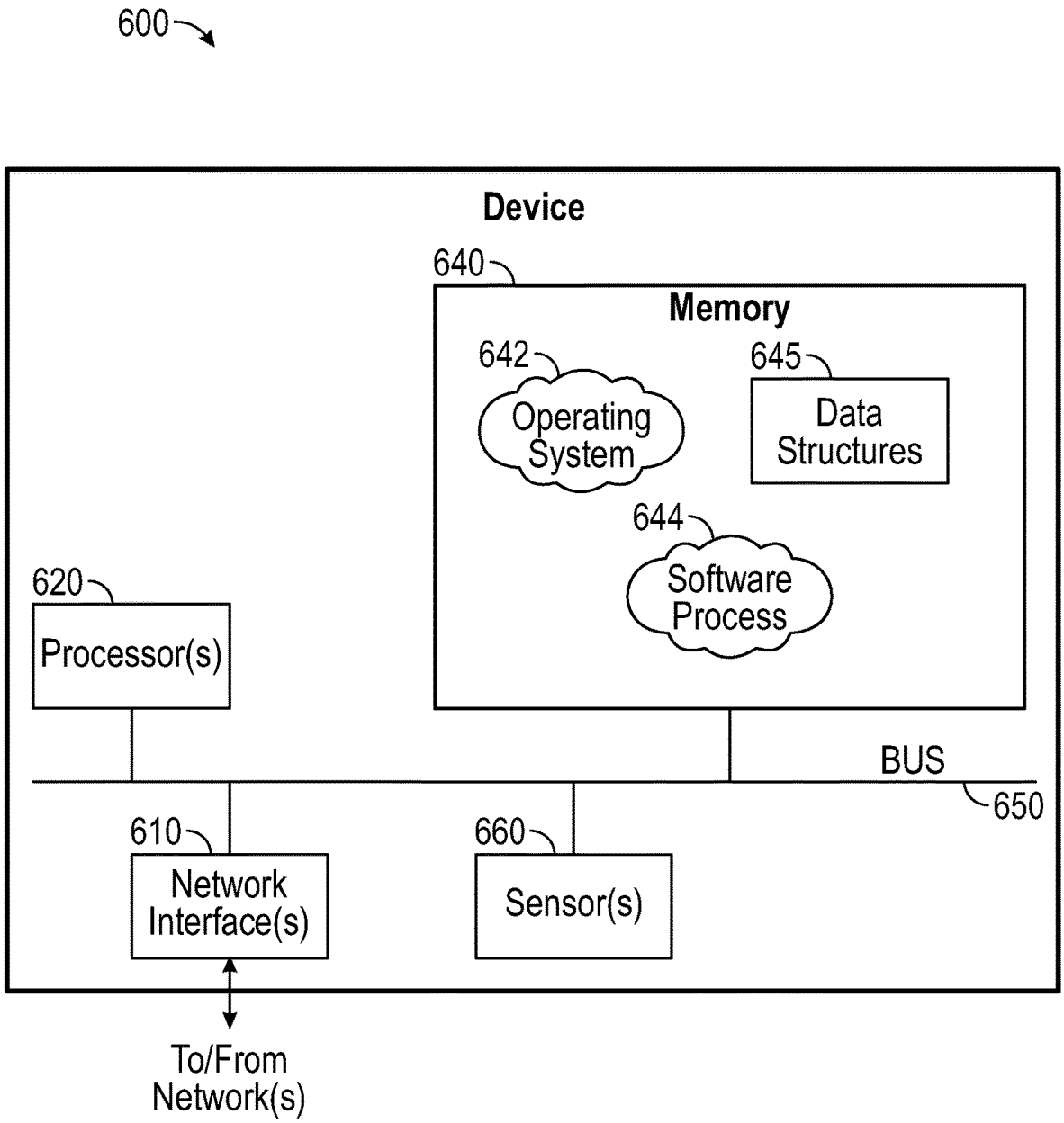
FIG. 6 is a schematic diagram of a controller.

FIG. 6 is a block diagram of an exemplary controller 600. The controller 600 can be utilized from the surface and/or remotely, as illustrated in FIGS. 1-5B. Controller 600 is configured to perform processing of data and communicate with the features as illustrated in FIGS. 1-5B. In operation, controller 600 communicates with one or more of the above-discussed components and may also be configured to communication with remote devices/systems.

As shown, controller 600 includes hardware and software components such as network interfaces 610, at least one processor 620, sensors 660 and a memory 660 interconnected by a system bus 650. Network interface(s) 610 can include mechanical, electrical, and signaling circuitry for communicating data over communication links, which may include wired or wireless communication links. Network interfaces 610 are configured to transmit and/or receive data using any variety of different communication protocols.

Processor 620 represents a digital signal processor (e.g., a microprocessor, a microcontroller, or a fixed-logic processor, etc.) configured to execute instructions or logic to perform tasks in a wellbore environment. Processor 620 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 620 typically operates in conjunction with shared or dedicated hardware, including but not limited to, hardware capable of executing software and hardware. For example, processor 620 may include elements or logic adapted to execute software programs and manipulate data structures 665, which may reside in memory 660.

Sensors 660 typically operate in conjunction with processor 620 to perform measurements, and can include special-purpose processors, detectors, transmitters, receivers, and the like. In this fashion, sensors 660 may include hardware/software for generating, transmitting, receiving, detection, and/or logging parameters.

Memory 660 comprises a plurality of storage locations that are addressable by processor 620 for storing software programs and data structures 665 associated with the embodiments described herein. An operating system 662, portions of which may be typically resident in memory 660 and executed by processor 620, functionally organizes the device by, inter alia, invoking operations in support of software processes and/or services 644 executing on controller 600. These software processes and/or services 644 may perform processing of data and communication with controller 600, as described herein. Note that while process/service 644 is shown in centralized memory 660, some examples provide for these processes/services to be operated in a distributed computing network.

Other processor and memory types, including various computer-readable media, may be used to store and execute program instructions pertaining to the wellbore tractor described herein. Also, while the description illustrates various processes, it is expressly contemplated that various processes may be embodied as modules having portions of the process/service 644 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 620 or computer readable medium encoded with instructions for execution by processor 620 that, when executed by the processor, are operable to cause the processor to perform the functions described herein.

Additionally, the controller 600 can apply machine learning, such as a neural network or sequential logistic regression and the like, for example to determine relationships between the movement of the components, the size of the cartridges, the shape of the cartridges, the type of cartridges, and/or the infusion material 210. For example, a deep neural network may be trained in advance to capture the complex relationship between the temperature applied to the needle and the operation of the heating components.

Figure 7:
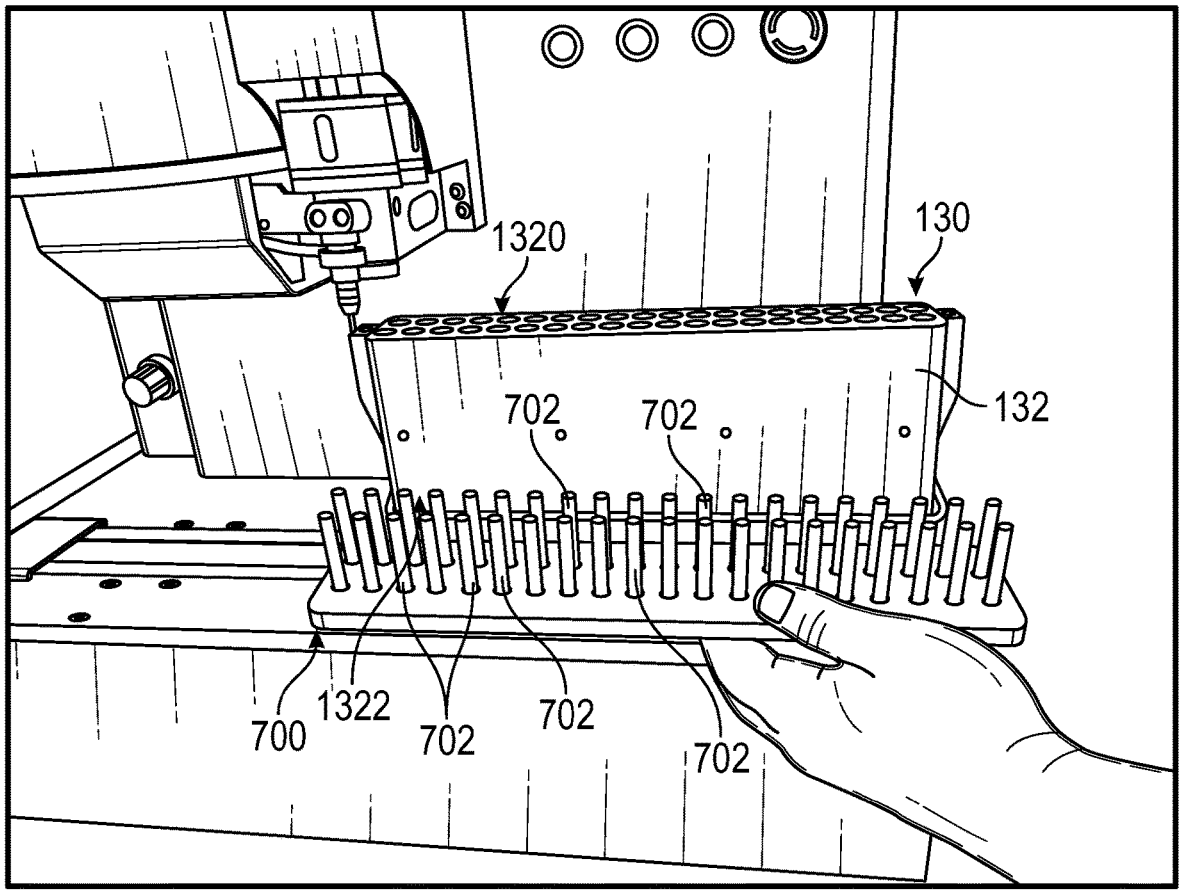
FIG. 7 is a perspective view of a removal component.

FIG. 7 illustrates a removal component 700 that is operable to remove the pre-rolls 200 from the pre-roll receiving component 130 (e.g., filling container 132). The removal component 700 can include a plurality of poles 702 operable to be inserted through corresponding bottom apertures 135 (for example as illustrated in FIG. 2D) in the pre-roll receiving component 130 to abut against and push the pre-rolls 200 out of a top 1320 of the pre-roll receiving component 130. The top 1320 can be proximate the lid 134. The lid 134 can be removed or lifted so that the pre-rolls 200 can be removed via the top 1320 of the pre-roll receiving component 130. The bottom apertures 135 can be formed in the bottom 1322 of the pre-roll receiving component 130. The bottom 1322 of the pre-roll receiving component 130 can be opposite the top 1320 of the pre-roll receiving component 130. The bottom apertures 135 can form holes that span from the bottom 1322 of the pre-roll receiving component 130 to the holding channels 139. Accordingly, the poles 702 can be inserted into the bottom apertures 135 until the poles 702 abut against the bottom end 222 of the pre-rolls 200 that are received in the holding channels 139. As the poles 702 are pushed further into the holding channels 139, the pre-rolls 200 are pushed out of the holding channels 139. By having a plurality of poles 702 that correspond with each of the holding channels 139, all of the pre-rolls 200 in the pre-roll receiving component 130 can be efficiently removed in one step.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. Rather, the described features and steps are disclosed as possible components of systems and methods within the scope of the appended claims.

What is claimed is:

1. A pre-roll filling system comprising:

a pre-roll receiving component including a plurality of holding channels, the plurality of holding channels operable to receive a plurality of pre-rolls, wherein the holding channels are arranged in at least one row extending along a longitudinal axis;

a filling component including a needle operable to deposit infusion material into each of the plurality of pre-rolls that are received in the plurality of holding channels, wherein at least a portion of the filling component is operable to translate along a vertical axis such that the needle is insertable into the holding channels; and a translating component operable to translate the pre-roll receiving component along the longitudinal axis so that each of the plurality of holding channels is aligned with the needle for the needle to be inserted into the holding channels.

2. The pre-roll filling system of claim 1, wherein the translating component includes continuous tracks that are moved by a translating motor.

3. The pre-roll filling system of claim 1, wherein the translating component includes a translating motor that is operable to translate the pre-roll receiving component along the longitudinal axis.

4. The pre-roll filling system of claim 1, wherein the translating component is operable to translate the pre-roll receiving component along the longitudinal axis in a first direction and a second direction opposite the first direction.

5. The pre-roll filling system of claim 1, wherein the filling component includes a needle motor can be operable to move the at least a portion of the filling component so that the needle is translated along the vertical axis to control the filling of the pre-rolls received in the plurality of holding channels.

6. The pre-roll filling system of claim 1, wherein the filling component is operable to move the needle into a corresponding holding channel of the plurality of holding channels and depositing the infusion material into the corresponding pre-roll received in the corresponding holding channel as the needle is lifted vertically towards a top of the corresponding holding channel.

7. The pre-roll filling system of claim 6, wherein the infusion material is deposited in a conical configuration.

8. The pre-roll filling system of claim 6, wherein the infusion material is deposited in a matchstick configuration.

9. The pre-roll filling system of claim 6, wherein the infusion material is deposited in a drop configuration.

10. The pre-roll filling system of claim 1, wherein the pre-roll receiving component includes a cover which forms a plurality of apertures operable to receive the needle, wherein the plurality of apertures corresponds with the plurality of holding channels.

11. The pre-roll filling system of claim 1, further comprising a needle heater that is coupled with the filling component, wherein the needle heater is operable to receive and heat air flowing from an air source.

12. The pre-roll filling system of claim 11, wherein the needle heater is in fluid communication with the needle such that the heated air flows onto the needle and heats the infusion material therein.

13. The pre-roll filling system of claim 1, wherein the infusion material includes at least one of: terpene fluid, resin, rosin, sauce, distillate oil, hash, wax, and/or flavoring material.

14. The pre-roll filling system of claim 1, wherein the translating component includes a tray operable to receive the pre-roll receiving component.

15. The pre-roll filling system of claim 1, further comprising a removal component operable to push the pre-rolls out of the pre-roll receiving component.

16. The pre-roll filling system of claim 15, wherein the removal component includes a plurality of poles operable to be inserted through corresponding bottom apertures in the pre-roll receiving component to abut against and push the pre-rolls out of a top of the pre-roll receiving component.

17. The pre-roll filling system of claim 1, wherein the translating component is operable to translate the pre-roll receiving component along a row axis transverse to the longitudinal axis.

18. The pre-roll filling system of claim 1, wherein the translating component is operable to move the pre-roll receiving component so that the needle is aligned with a second row of the pre-roll receiving component.

* * * * *